US010668640B1

(12) United States Patent
Kingan

(10) Patent No.: US 10,668,640 B1
(45) Date of Patent: Jun. 2, 2020

(54) MOBILE POST PUNCH MACHINE

(71) Applicant: MINNICH MANUFACTURING COMPANY, INC., Mansfield, OH (US)

(72) Inventor: Troy Kingan, Mansfield, OH (US)

(73) Assignee: Minnich Manufacturing Company, Inc., Mansfield, OH (US)

( * ) Notice: Subject to any disclaimer, the term of this patent is extended or adjusted under 35 U.S.C. 154(b) by 475 days.

(21) Appl. No.: 15/441,525

(22) Filed: Feb. 24, 2017

Related U.S. Application Data

(60) Provisional application No. 62/299,820, filed on Feb. 25, 2016.

(51) Int. Cl.
*B26F 1/44* (2006.01)
*B26D 5/12* (2006.01)
(Continued)

(52) U.S. Cl.
CPC ..... *B26F 1/44* (2013.01); *B26D 5/12* (2013.01); *B26D 7/2628* (2013.01); *B26F 2001/4463* (2013.01); *B66B 23/00* (2013.01)

(58) Field of Classification Search
CPC ..... Y10T 83/538; Y10T 83/8743; Y10T 83/8858; Y10T 408/175; B21D 28/243;
(Continued)

(56) References Cited

U.S. PATENT DOCUMENTS 599,276 A 2/1898 Werner
1,830,977 A 11/1931 Banfer
(Continued)

FOREIGN PATENT DOCUMENTS

CN 201659194 U 12/2010
CN 102198468 B 9/2011
(Continued)

OTHER PUBLICATIONS

"Peddinghaus Processing Systems for Flat Bar and Plate Fabrication" published by Peddinghaus Corproation, 300 N. Washington Ave., Bradley, IL 60915 U.S.A. 12 pages, https://akamai.peddi.com/pdf/plate-processors/fpb-1800-plate-processor.pdf.
(Continued)

*Primary Examiner* — Zachary L Kuhfuss
(74) *Attorney, Agent, or Firm* — Vorys, Sater, Seymour and Pease LLP; Scott M. Guttman, Esq.

(57) ABSTRACT

An apparatus for punching holes in posts in a transportation environment where the offset between the holes in the post and a vehicle running surface of a vehicle is constant over a transportation route. The apparatus has a frame and a hole forming assembly separate from one another, such that the hole forming assembly may be adjusted relative to the frame. The hole forming assembly can be adjusted relative to the frame and can be set at a specific offset between a location where the holes are to be formed in a post and the vehicle running surface. Once the offset is set, the apparatus maintains this offset for every post punched along the transportation route, so that there is a constant offset between the holes punched in the posts and the vehicle running surface.

14 Claims, 17 Drawing Sheets

(51) Int. Cl.
*B26D 7/26* (2006.01)
*B66B 23/00* (2006.01)

(58) Field of Classification Search
CPC ..... B21D 28/265; B26D 5/12; B26D 7/2628; B26F 1/44; B26F 2001/4463
See application file for complete search history.

(56) References Cited

U.S. PATENT DOCUMENTS

| | | | |
|---|---|---|---|
| 1,887,424 | A | 11/1932 | Perazzoli |
| 2,015,329 | A | 9/1935 | Anderson |
| 2,483,933 | A | 1/1950 | Russell et al. |
| 2,603,255 | A | 7/1952 | Woolery |
| 2,776,712 | A | 1/1957 | Carlson |
| 3,253,484 | A | 5/1966 | Hill |
| 3,572,082 | A | 3/1971 | Payne |
| 3,572,204 | A | 3/1971 | McConnell |
| 3,614,078 | A | 10/1971 | Hepler |
| 3,667,333 | A | 6/1972 | Flynn, Jr. |
| 3,712,161 | A | 1/1973 | Valente |
| 3,803,961 | A | 4/1974 | Valente |
| 3,805,659 | A | 4/1974 | Fisher, Jr. |
| 3,817,135 | A | 6/1974 | Valente |
| 3,858,471 | A | 1/1975 | Valente |
| 3,892,154 | A | 7/1975 | Duffy |
| 3,897,707 | A | 8/1975 | Kruse et al. |
| 3,924,330 | A | 12/1975 | Mitsuhashi et al. |
| 3,996,830 | A | 12/1976 | Peddinghaus |
| 4,029,427 | A | 6/1977 | Cloup |
| 4,030,853 | A | 6/1977 | Mizen |
| 4,040,320 | A | 8/1977 | Cloup |
| 4,061,064 | A | 12/1977 | Kindgren et al. |
| 4,136,592 | A | 1/1979 | Beatty |
| 4,198,181 | A | 4/1980 | Smelser |
| 4,266,989 | A | 5/1981 | Ludwigson |
| 4,294,046 | A | 10/1981 | Damiano |
| 4,327,785 | A | 5/1982 | McIlrath |
| 4,637,314 | A | 1/1987 | Gower |
| 4,713,592 | A | 12/1987 | Memmel |
| 4,731,929 | A | 3/1988 | McClure |
| 4,786,215 | A | 11/1988 | McClure |
| 5,063,804 | A | 11/1991 | Magnuson |
| 5,161,298 | A | 11/1992 | Stursberg |
| 5,199,339 | A | 4/1993 | Creech |
| 5,243,893 | A | 9/1993 | Evans et al. |
| 6,832,873 | B1 | 12/2004 | Kadrnoska et al. |
| 8,021,086 | B2 | 9/2011 | Rogers et al. |
| 8,215,238 | B2 | 7/2012 | Roop |
| 8,453,577 | B2 | 6/2013 | Gordon |
| 9,283,609 | B2 * | 3/2016 | Huang ..... B30B 1/16 |
| 2005/0001048 | A1 | 1/2005 | Skoblenick et al. |
| 2005/0115375 | A1 | 6/2005 | Dick et al. |
| 2018/0104839 | A1 * | 4/2018 | Jeffers ..... B26D 5/12 |

FOREIGN PATENT DOCUMENTS

| | | |
|---|---|---|
| CN | 102493293 A | 1/2015 |
| DE | 529920 | 7/1931 |
| FR | 508737 | 10/1920 |
| GB | 136349 | 12/1919 |

OTHER PUBLICATIONS

"Peddinghaus Peddimat Structural Fabrications Systems for Economical Structural Steel Fabrication" published by Peddinghaus Corporation, 300 N. Washington Ave., Bradley, IL 60915 U.S.A. and bearing on the last page, the desigation 683 GC5M, pp. 10 and 11.

* cited by examiner

MOBILE POST PUNCH MACHINE

CROSS-REFERENCE TO RELATED APPLICATIONS

This application claims the benefit of U.S. Provisional Application No. 62/299,820 entitled "Mobile Post Punch Machine" filed on Feb. 25, 2016, which is incorporated by reference herein in its entirety.

BACKGROUND

Field of the Disclosure

The disclosure generally relates to automated transportation systems, and more particularly to a mobile post punch machine for building such a system.

Description of Related Art

Automated transportation systems are known in the art. These can include an automated people mover, a platform, elevated siderails, and plinths. An automated people mover moves people back and forth along a predetermined route of an automated transportation system at venues such as airports or other types of transportation centers. Automated people movers do not have a person (i.e. a conductor) on board that drives, operates, or controls the automated people mover. Instead, such a people mover is typically controlled from a central control room that controls multiple of the people movers.

For the central control room to operate and control the people movers, the control room must be in contact or communication with each of the people movers of the system. This is typically accomplished by having an elevated siderail run along the length of the route of the people mover. The people mover typically has electrical contacts coupled to a power source and electrical lines enclosed and supported by the siderail to power and control the people mover. The siderail also typically serves the function of supporting a vehicle side-loading wheel of the people mover to ensure the vehicle travels within a defined travel envelope (e.g. defined sway/movement area).

The power and travel envelope functions of the siderail are critical to the operation of the people mover. For the people mover to work properly and within the defined travel envelope, the people mover and the siderail must maintain a specific alignment with each other throughout the entire route of the automated transportation system, even when the route has horizontal curves and vertical grade breaks or elevation changes. The specific alignment required between the people mover and the siderail is maintained by making sure, when the transportation route is installed, that the offset between a specific location (e.g. center line) on the siderail and the tire running surfaces of the people mover (i.e. the plinths) is constant throughout the entire route. The plinths (i.e. the guideway deck) are the surfaces that support the people mover, such as wheels, as it travels along its designated route. The offset between siderails and the plinths can vary from project to project and are not required to always be the same for each project. In one example, the specified location on the siderails may be required to have a constant 10 7/16" offset in relation to the plinths. In other examples, the offset can be different.

The siderails are supported by posts, typically in the form of I-Beams. To connect the siderail to the posts, holes are typically formed in a flange on the side of the I-Beam to which the siderail is to be connected. After the holes are formed in the flanges, the siderail is bolted to the posts. The location of the holes in the flange on each post is critical because the holes define and maintain the offset between the siderail and the plinth.

To put the holes in a post, common practice is to have a person, using a punch machine, walk up to each individual post and punch the holes. In doing so, the person first makes sure the offset between the post and the plinth is correct and then punches the holes in the flange. For a large project, one significant problem is that it takes an inordinate amount of time to properly locate and punch the holes in every post in this manner. By way of example, one project may have over 18,000 holes that must be punched. Another problem is that the person punching the holes must walk from post to post punching all of the holes. This can result in an extremely slow and inefficient process.

The tedious and manual nature of the process can also potentially introduce significant human error with respect to properly locating each and every hole. If the holes are not punched in the required spot, then the critical offset between the siderail and the plinth will be incorrect and out of alignment. As a result, the people mover will not connect with the siderail as required and will not work. This potential for human error is exacerbated exponentially when the people mover does not run in a straight line, which is the case on almost all projects. There are often superelevation areas along the people mover route where there are horizontal curves and vertical grade breaks. In these areas, the geometry between the posts and the plinths changes along the course of the route. Even though the elevations are changing, the offset between the siderails and the plinths must be maintained. This becomes extremely difficult when the holes are being punched by a person walking from post to post to line up the offset and punch the holes.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

Figure 1:
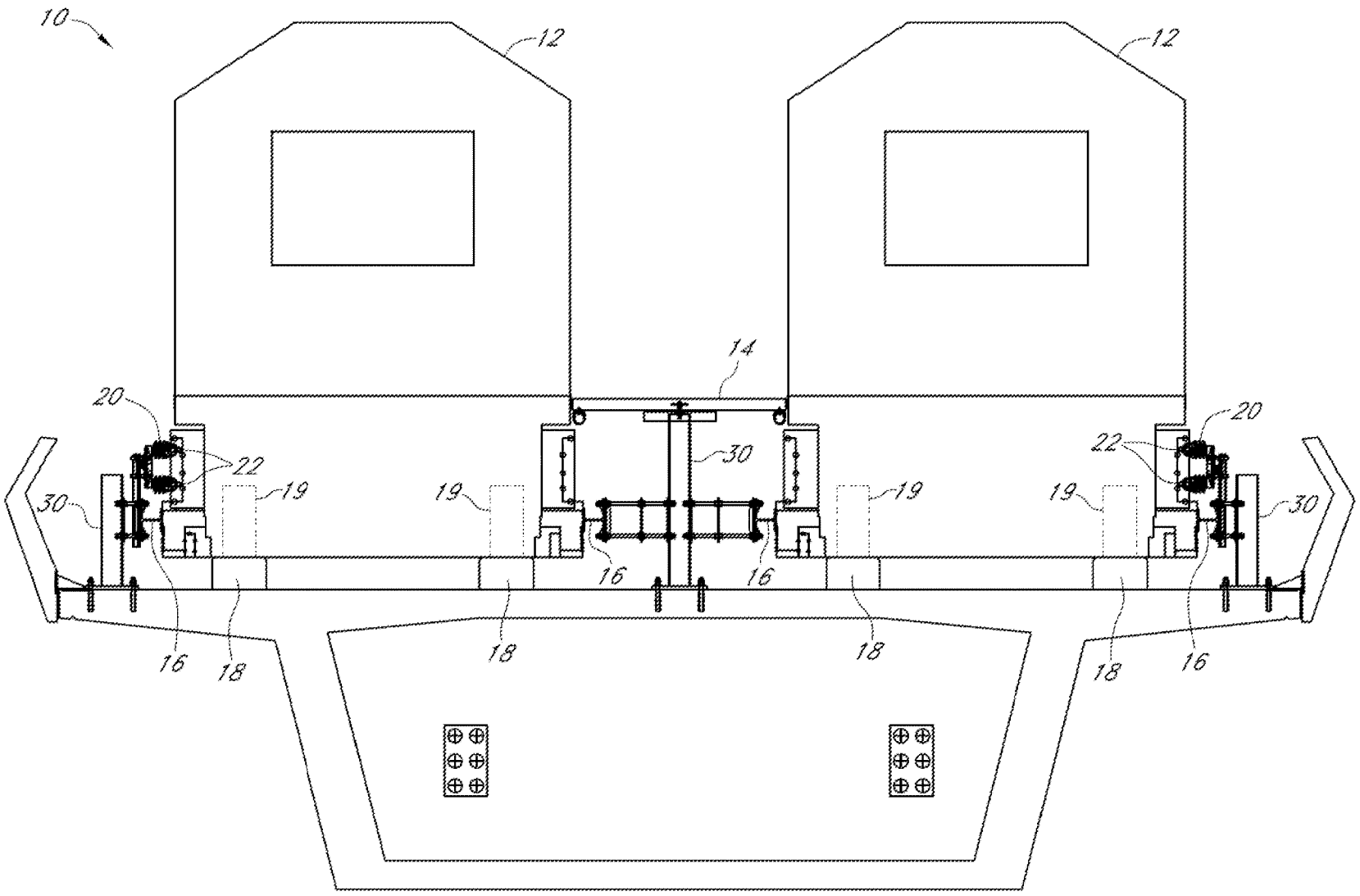
FIG. 1 depicts an automated transportation system illustrating the relationship between the plinths and the siderails.

What is needed is a device that punches holes in posts on a transportation project that can easily be moved from post to post while maintaining the required offset between the siderail and the plinth.

Referring to FIGS. 1, 2A-2B and 3, an automated transportation system 10 is depicted, which includes automated people movers 12, a platform 14, elevated siderails 16 and plinths 18. The elevated siderail 16 run along the length of the route of the people mover 12 and house an electrical line 20 that powers and controls the people mover 12. In operation, the people mover 12 has electrical contacts 22 that contact a power source enclosed and supported by the siderail 16 to power and control the people mover 12. The siderail 16 may also serve the function of supporting a vehicle side-loading wheel of the people mover 12 to ensure the vehicle travels within a defined travel envelope (e.g. defined sway/movement area).

Figure 2A:
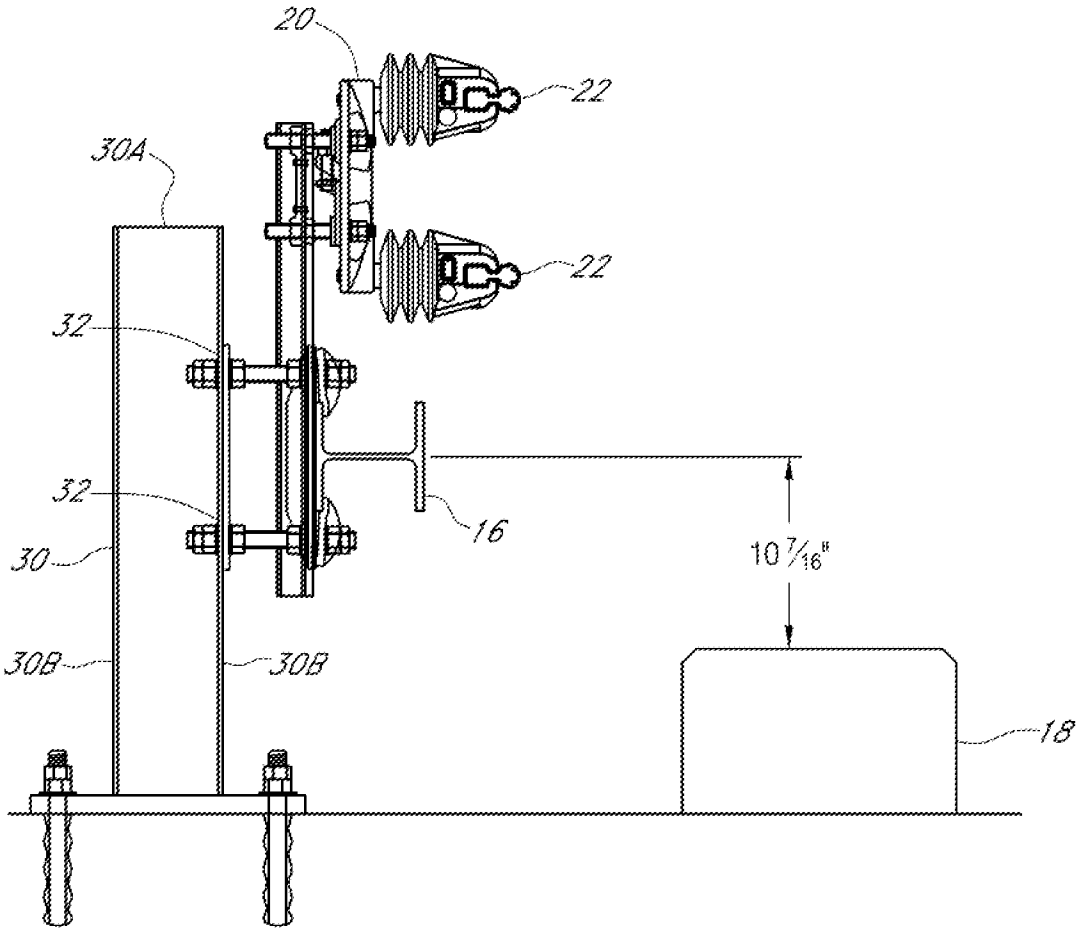
FIG. 2A depicts the relationship between a plinth and a siderail.
Figure 2B:
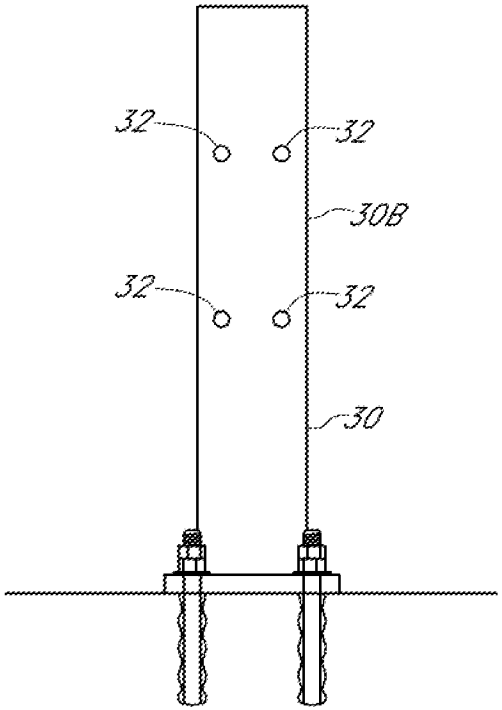
FIG. 2B is a side view of a post with the siderail removed.

The specific alignment required between the people mover 12 and the siderail 16 is maintained by making sure, when the transportation route is installed, that the offset between a specific location (e.g. center line) on the siderail 16 and the tire running surfaces of the people mover 18 (i.e. a plinth) are constant throughout the entire route. The plinths 18 (i.e. the guideway deck) are the surfaces that support the people mover 12, specially wheels 19 of the mover 12, as it travels along its designated route. The offset between siderails 16 and the plinths 18 can vary from project to project and are not required to always be the same for each project. In one example, as depicted in FIG. 2A, the specified location on the siderails 16 is required to have a constant 10⁷⁄₁₆" offset in relation to the plinths 18. Again, to make clear, this offset can vary, depending on the project requirements and does not have to be 10⁷⁄₁₆" for every project.

The siderails 16 are supported by posts 30, typically I-Beams. The I-Beams or posts 30 in this example have a web 30A and flanges 30B (see FIGS. 2A and 2B). To connect the siderail 16 to the post 30, holes 32 are typically formed in the flange 30B on the side to which the siderail 16 is to be connected. After the holes 32 are formed in the flange 30B, the siderail 16 is bolted to the post 30. The location of the holes 32 in the flange 30B is critical because the holes 32 define and maintain the offset between the siderail 16 and the plinth 18 ("siderail/plinth offset"). In the example shown in FIG. 2A, the constant offset that needs to be maintained between the siderail 16 and the plinth 18 is 10⁷⁄₁₆". As mentioned above, the offset could be any dimension as required by the project.

Figure 3:
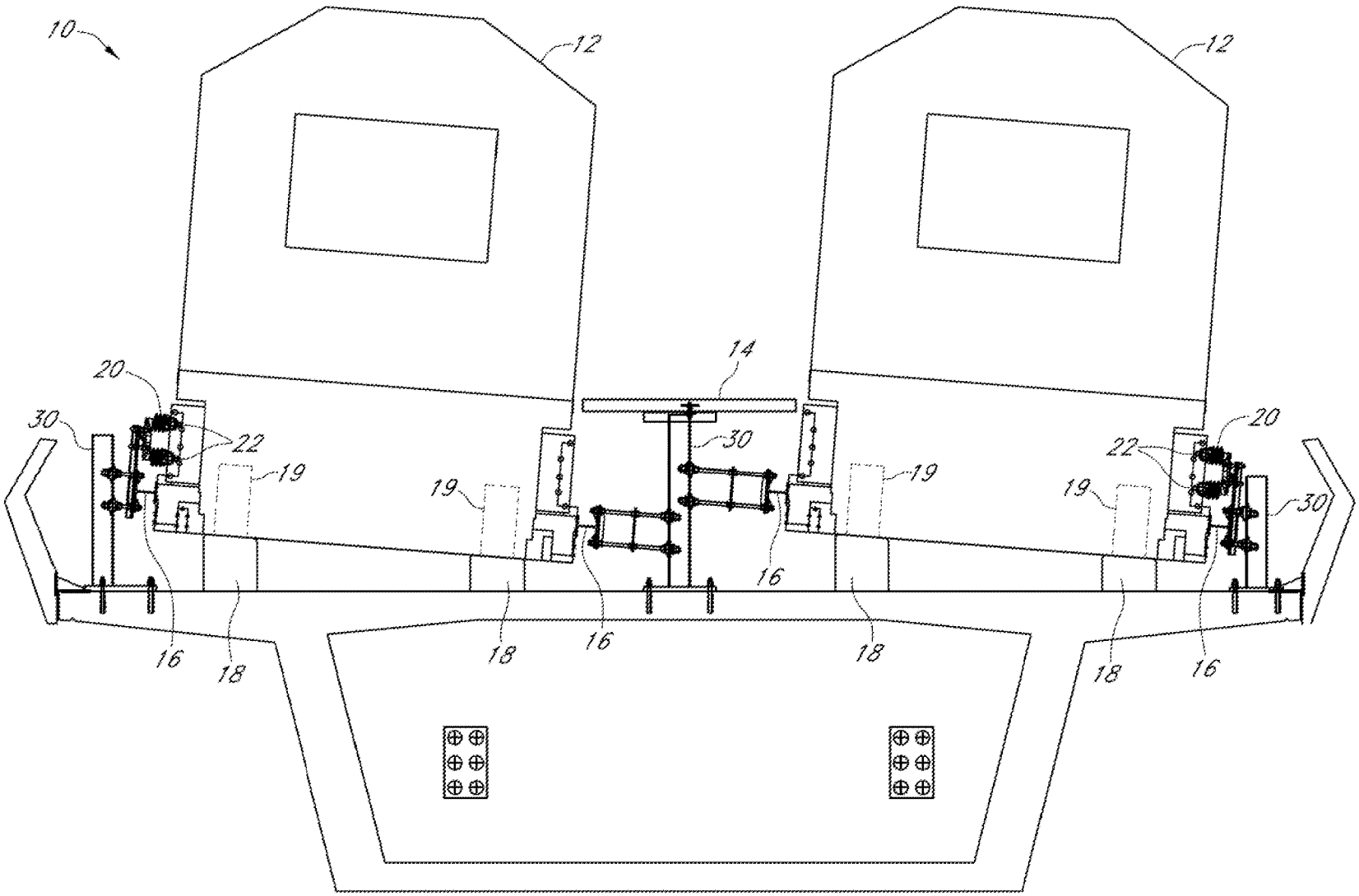
FIG. 3 depicts the relationship between a set of plinths and a set of siderails in relation to the automated transportation system in a superelevation portion of the transportation route.

If the holes 32 are not punched in the required spot, then the critical offset between the siderail 16 and the plinth 18 is incorrect and out of alignment. As a result, the people mover 12 will not connect with the siderail 16 as required and will not work. In FIG. 3, there are superelevation areas along the people mover route where there are horizontal curves and vertical grade breaks. In these areas, the geometry between the posts 30 and the plinths 18 changes along the course of the route. Even though the elevations are changing, the offset between the siderails 16 and the plinths 18 must be maintained. As noted above, this becomes extremely difficult when the holes 32 are being punched by a person walking from post 30 to post 30 to line up the offset and punch the holes 32.

What is needed is a device that punches holes in posts on a transportation project that can easily be moved from post to post while maintaining the required offset between the siderail and the plinth. The invention disclosed herein is capable of being presented in many different embodiments and forms, and it is to be understood that the present disclosure is to be considered an exemplification of the principles of the invention with exemplary embodiment(s) and is not intended to limit the invention to the specific embodiments described and illustrated herein.

Figure 4A:
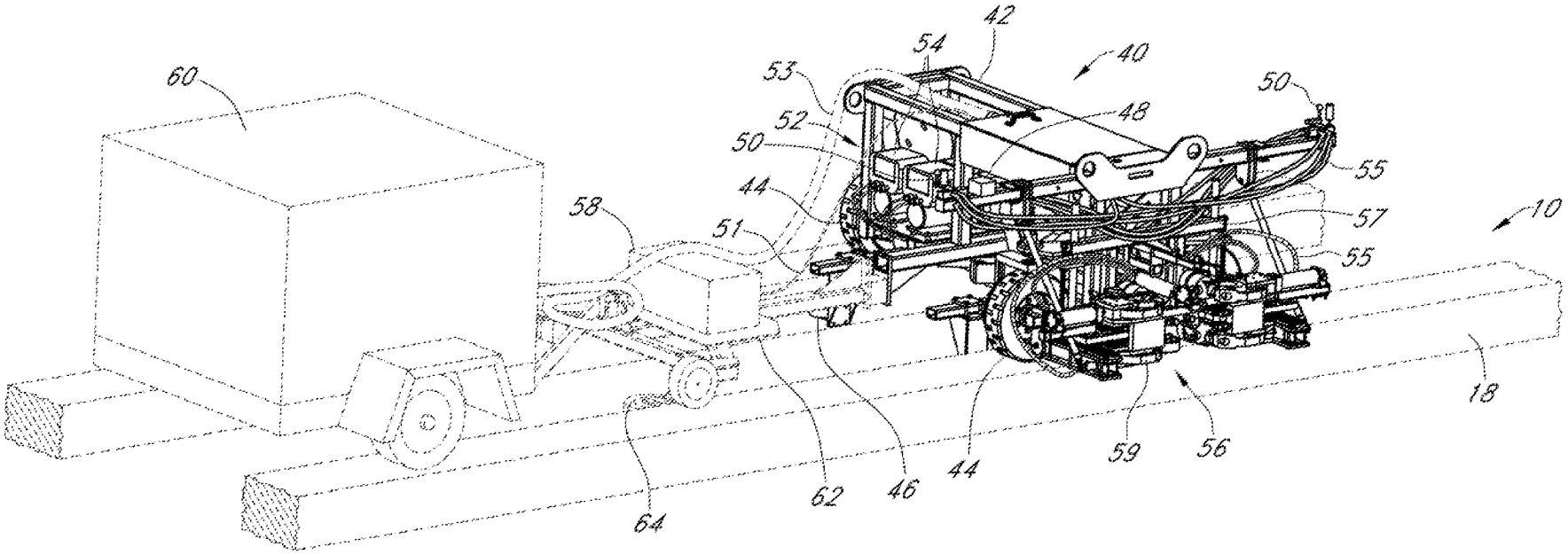
FIG. 4A is a perspective view of the mobile post punch machine of the present invention depicting the wires and hoses and depicting a power assembly and a compressor attached.
Figure 4B:
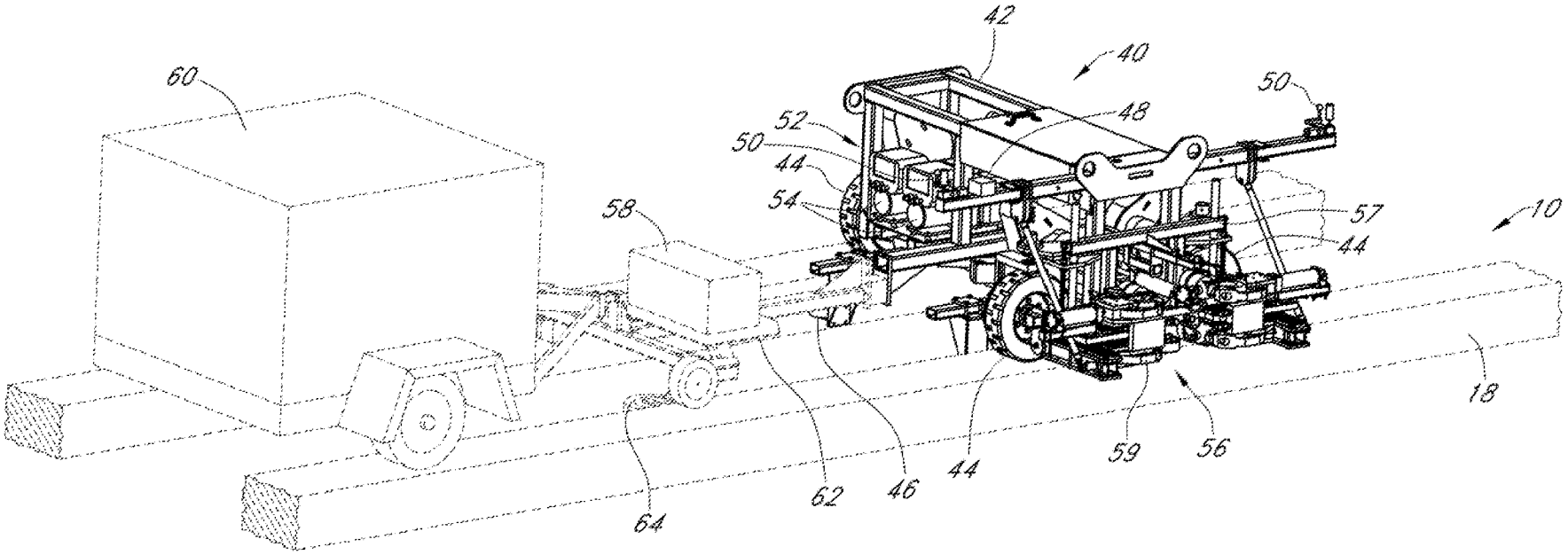
FIG. 4B is a perspective view of the mobile post punch machine of the present invention similar to FIG. 4A with the wires and hoses removed to aid in viewing the components of the present invention.
Figure 7:
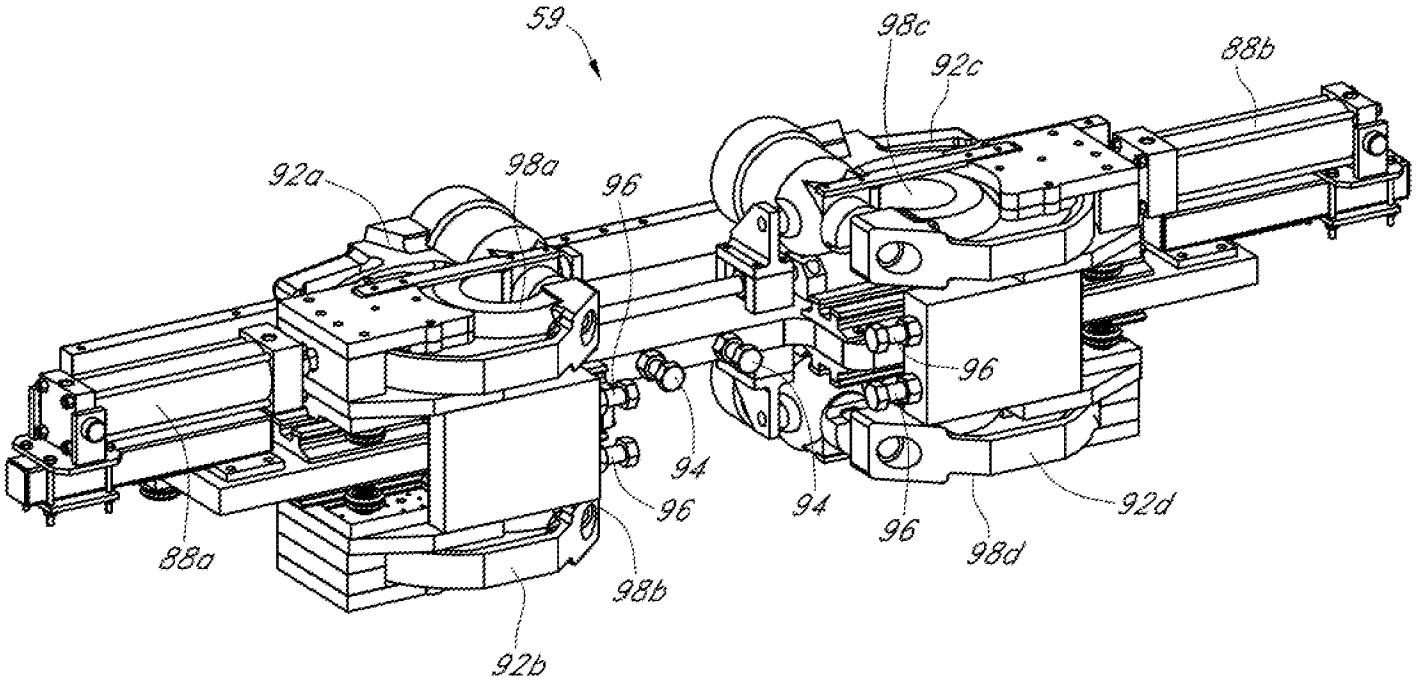
FIG. 7 is a detailed view of a claw punch assembly of a hole forming assembly of the present invention with the wires and hoses removed to aid in viewing the components of the present invention.
Figure 8:
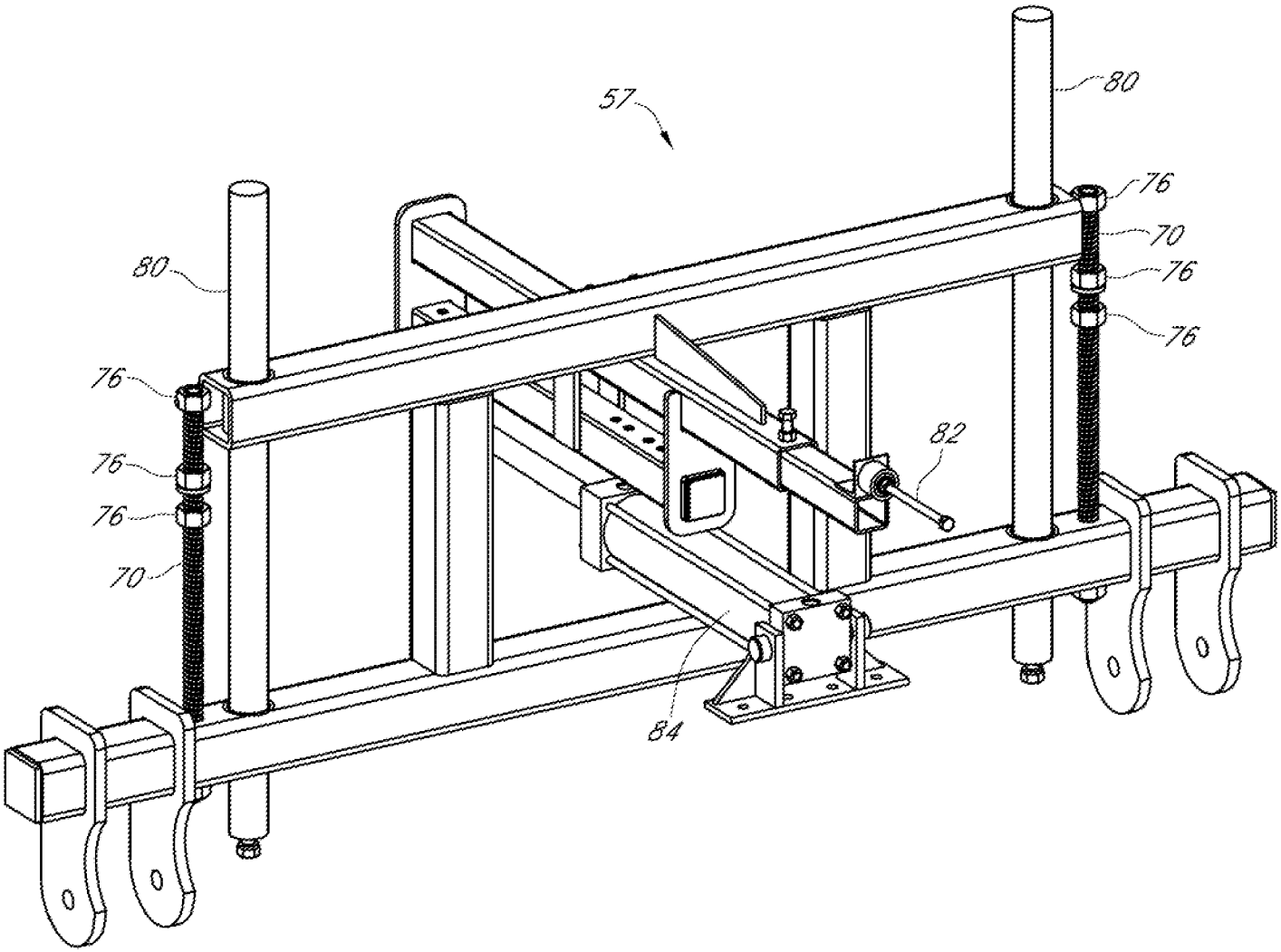
FIG. 8 is a detailed view of a lift assembly of a hole forming assembly of the present invention.

Referring to FIGS. 4A-C, 5 and 6, an embodiment of a post punch machine 40 of the present invention is depicted. The punch machine 40 includes a machine frame 42, support wheels 44, alignment wheels 46, a control assembly 48, including joysticks 50 and wires 51, a hydraulic assembly 52, including hydraulic pumps 54 and hoses 55, and a hole forming assembly 56. (The wires 51 and the hoses 55 are only depicted in FIG. 4A and are removed from the later figures to make it easier to see the components of the invention.) The hole forming assembly 56 includes a lift assembly 57 (FIG. 8) and a claw punch assembly 59 (FIG. 7). The lift assembly 57 supports the claw punch assembly 59 and connects the claw punch assembly 59 to the machine frame 42. In operation, in this embodiment, the post punch machine 40 is connected to a power assembly 58 and an air compressor 60. One embodiment is depicted in FIG. 4A for arranging and connecting the power assembly 58 and the air compressor 60 to the post punch machine 40. In this embodiment, the air compressor 60 connects to the machine 40 through hose 53 and the power assembly 58 is a generator and is supported external to the post punch machine 40 on a support frame 62 which also includes alignment wheels 64. This is just one embodiment for arranging the post punch machine 40, the power assembly 58 and the compressor 60. The invention is not so limited. For instance, in another embodiment, the post punch machine 40, the power assembly 58 and the compressor 60 could be built integral to one another in one unit.

As shown in FIG. 4A, the post punch machine 40 is designed to ride along the plinths 18 of an automated people mover system 10. As such, the machine frame 42 of the punch machine 40 can be built to fit the dimensions of the plinths 18 or it can be built to be adjustable to fit those dimensions. All of the components of the post punch machine 40 are connected to and/or are supported by the machine frame 42. The hole forming assembly 56 is connected to the machine frame 42, but the hole forming assembly 56 is a separate assembly from the machine frame 42 and can be adjusted in height relative to the machine frame 42. As described in more detail below, adjusting the hole forming assembly 56 relative the machine frame 42 is how the siderail/plinth offset described above is adjusted, set and maintained throughout the post punching project.

Figure 9B:
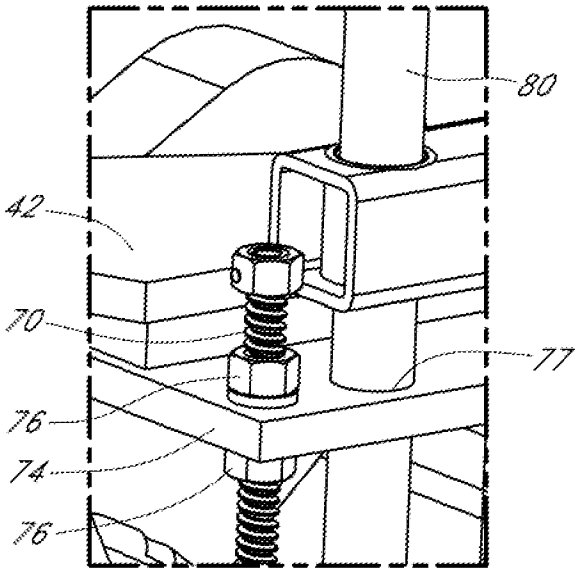
FIG. 9B depicts the plinth/side offset in a second position.
Figure 9A:
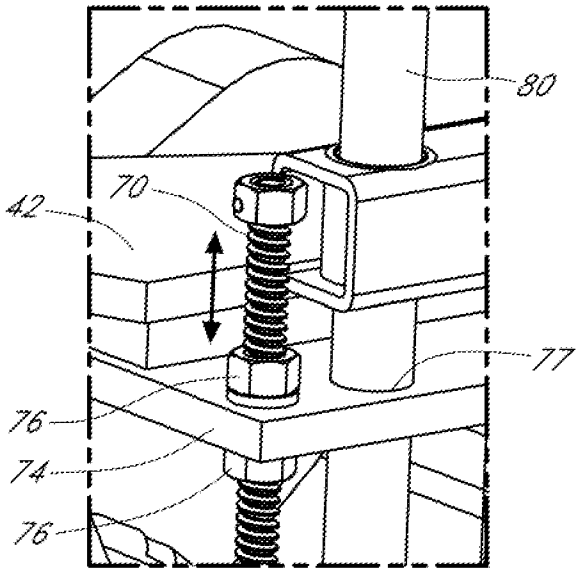
FIG. 9A depicts the plinth/side offset in a first position.

Referring to FIGS. 4C, 8 and 9A-B, the lift assembly 57 of the hole forming assembly 56 has threaded bolts 70 and adjustable rods 72, and the threaded bolts 70 and the adjustable rods 72 connect the hole forming assembly 56 to the machine frame 42. Referring to FIG. 9A, specifically, the threaded bolts 70 pass through flanges 74 in the machine frame 42 and nuts 76 are used to lock the threaded bolts 70 in place relative to the flanges 74. The adjustable rods 72 (FIG. 4C), which are moveable relative to the machine frame 42, are connected to the machine frame 42 at brackets 78. The lift assembly 57 also has stabilization rods 80 that pass through holes 77 in the flange 74 (FIGS. 9A-9B), which move when the threaded bolts 70 are adjusted. The rods 80, along with other components, act to stabilize the hole forming assembly 56 relative to the machine frame 42. In this embodiment, the hole forming assembly 56 also includes an alignment device 82, an outward extending hydraulic arm 84, two sliding rails 86, opposing hydraulic claw arms 88*a-b*, punch claws 92*a-d*, each having dies 98, which is known as the mouth or neck of a punch rig, stop-bolts 94 and opposing claw arm stop-bolts 96. In this embodiment, the post punch machine 40 includes four punch claws 92*a-d*, but any number of punch claws 92 can be used. In this embodiment, punch claws 92*a-b* move together and punch at the same time. In a similar manner, punch claws 92*c-d* move together and punch at the same time. In other embodiments, the punch claws 92 could work in other ways, such as each one working independently, all of the punch claws punching at the same time or some other variant. The punch claws 92*a-d* are controlled by an operator who uses the control assembly 48, including a joystick 50, to operate the machine 40.

Figure 4C:
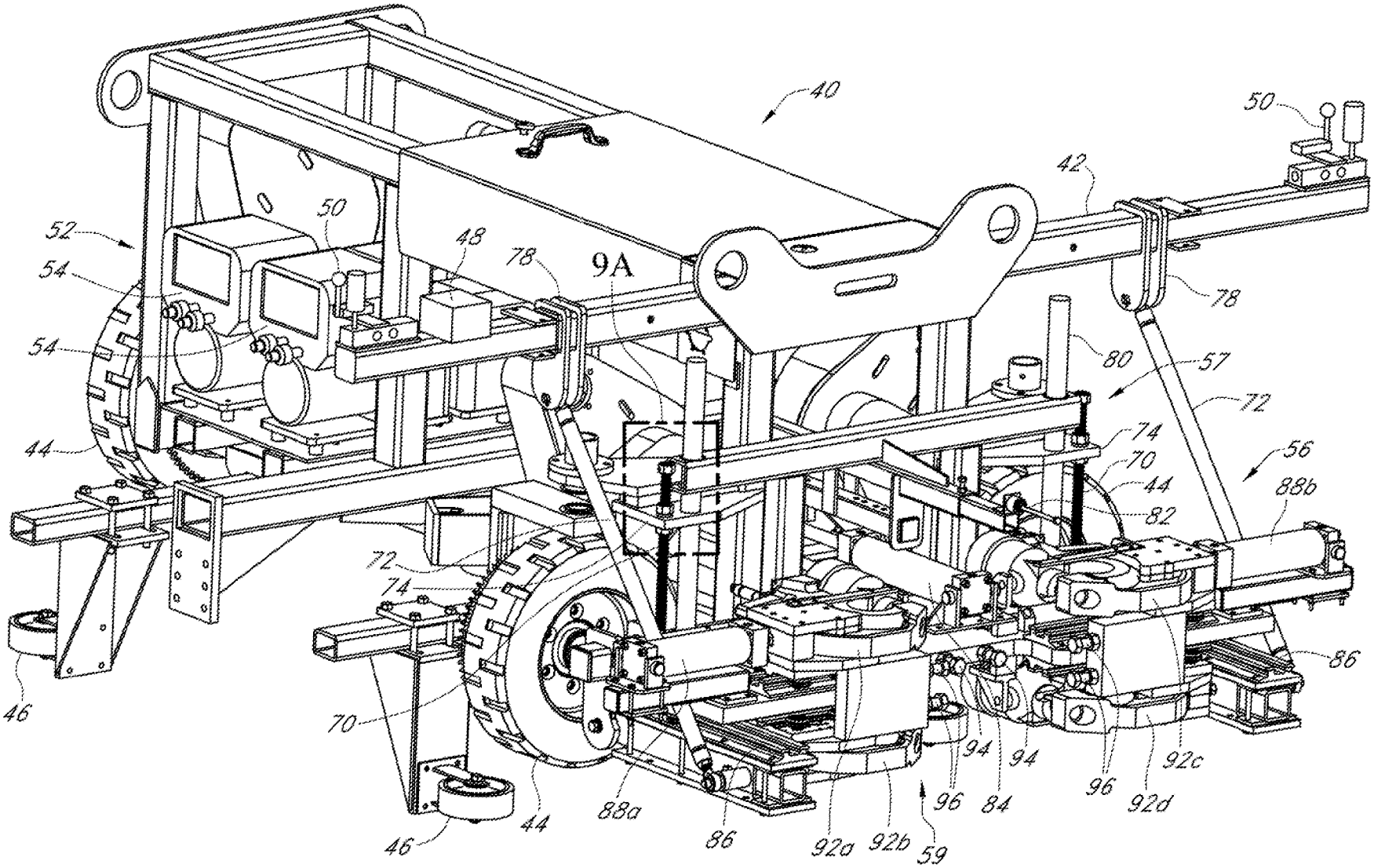
FIG. 4C is a perspective view of the mobile post punch machine of the present invention with the wires and hoses removed to aid in viewing the components of the present invention.
Figure 5:
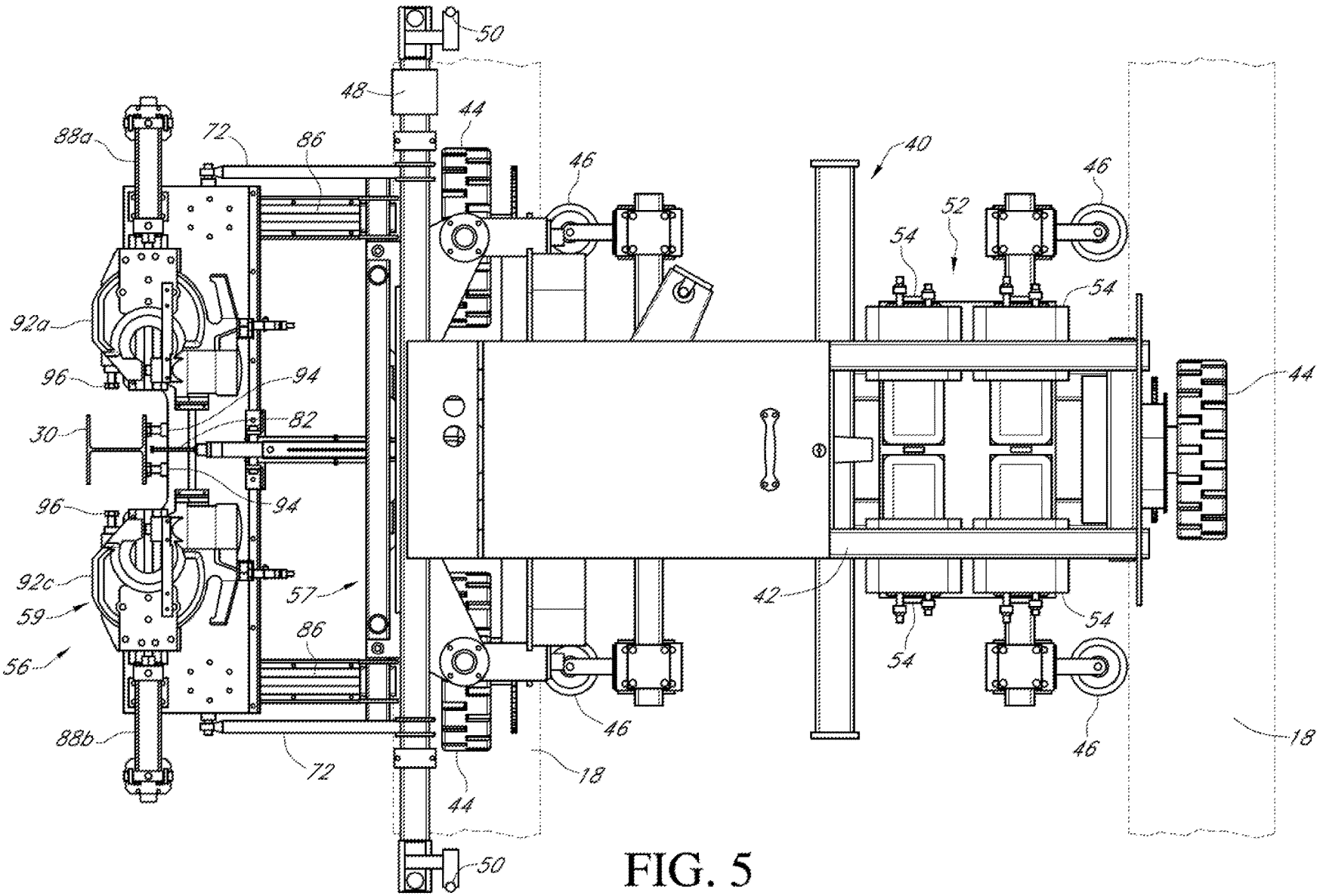
FIG. 5 is a top plan view of the mobile post punch machine of the present invention with the wires and hoses removed to aid in viewing the components of the present invention.
Figure 6:
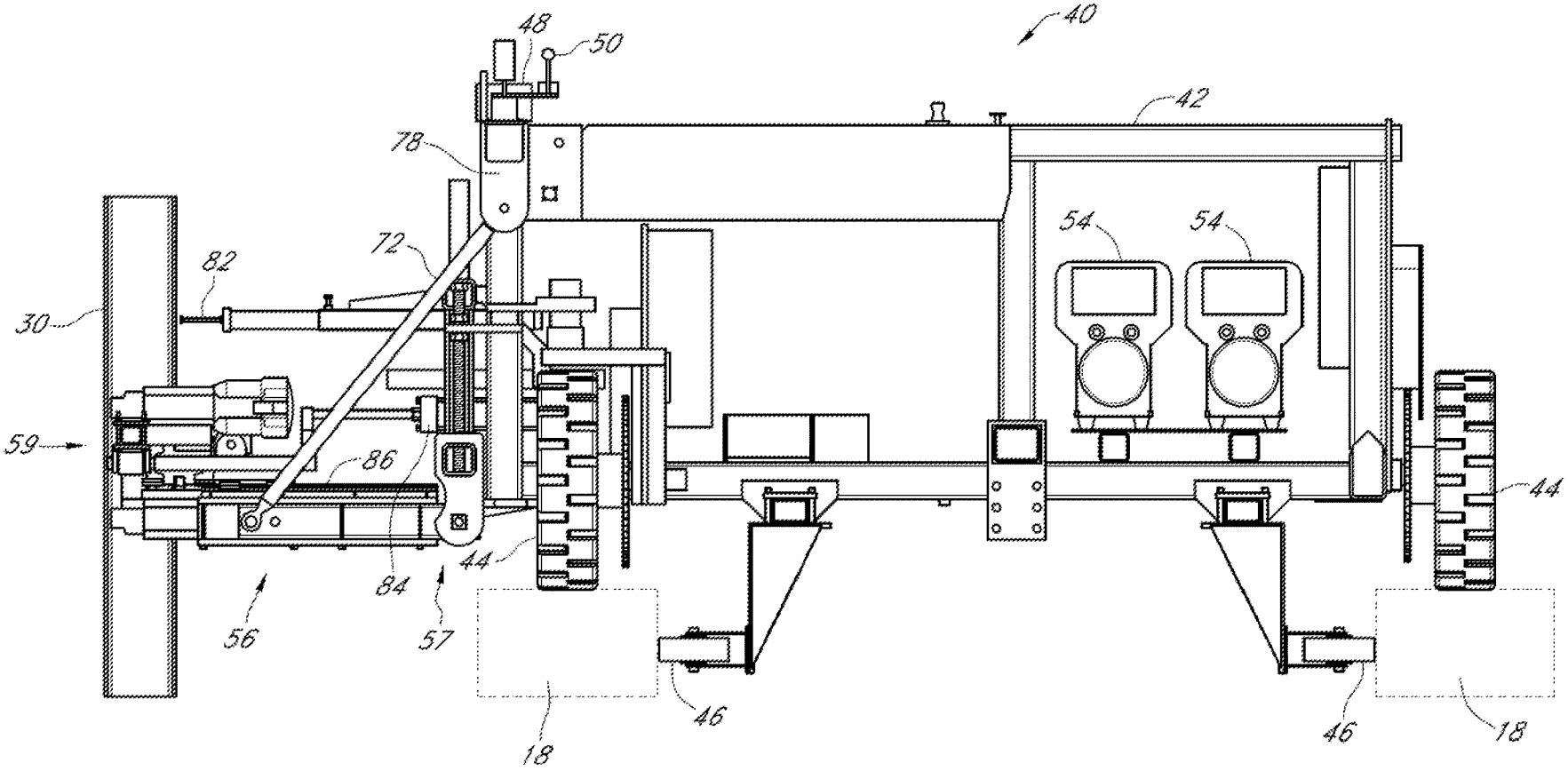
FIG. 6 is an end view of the mobile post punch machine of the present invention with the wires and hoses removed to aid in viewing the components of the present invention.

To operate the post punch machine 40, one of the first things to be done is to set the siderail/plinth offset (i.e. the vertical distance between where the centerpoint for the holes 32 are to be punched and the plinth 18). The offset can be set before putting the post punch machine 40 on the plinths 18 or after. By setting this offset, it ensures that the siderail/plinth offset is maintained throughout the course of the project and that the holes 32 are punched in the proper spot, removing the error that was introduced in the past when a person was required to determine the proper hole centerpoint for each and every post 30 on the project. Referring to FIGS. 4C and 9A-B, to set the siderail/plinth offset, the nuts 76 are loosened on both sides of the flange 74 for all of the threaded bolts 70 on the lift assembly 57. In this embodiment, there are two threaded bolts 70. With the nuts 76 loosened, the lift assembly 57, and consequently, the hole forming assembly 56, is then moved up or down until the distance between the centerpoint of the punch claws 92*a-d* and the plinth 18 match the offset designated for the project for the offset between the centerpoint of the holes 32 in a post 30 and a plinth 18. In the example used herein, the offset is set at 10 7/16". With the threaded bolts 70 at the right height, the nuts 76 are tightened down to lock the hole forming assembly 56 in place relative to the machine frame 40 (FIG. 9B). At the same time the threaded bolts 70 are being adjusted relative to the flanges 74, the adjustable rods 72 are adjusted as well.

Figure 10A:
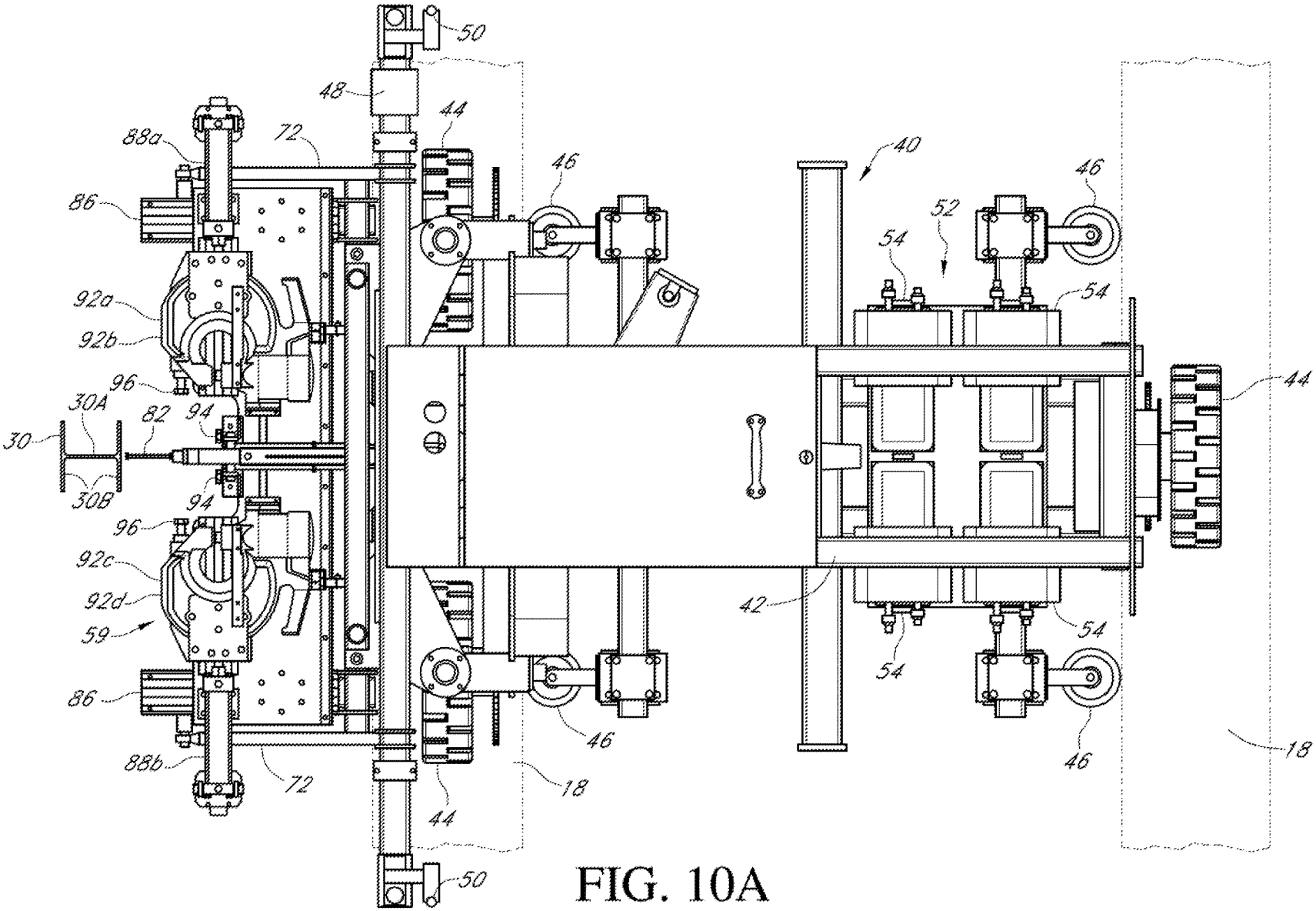
FIG. 10A depicts the mobile post punch machine of the present invention aligned with the post, with the wires and hoses removed to aid in viewing the components of the present invention.
Figure 10B:
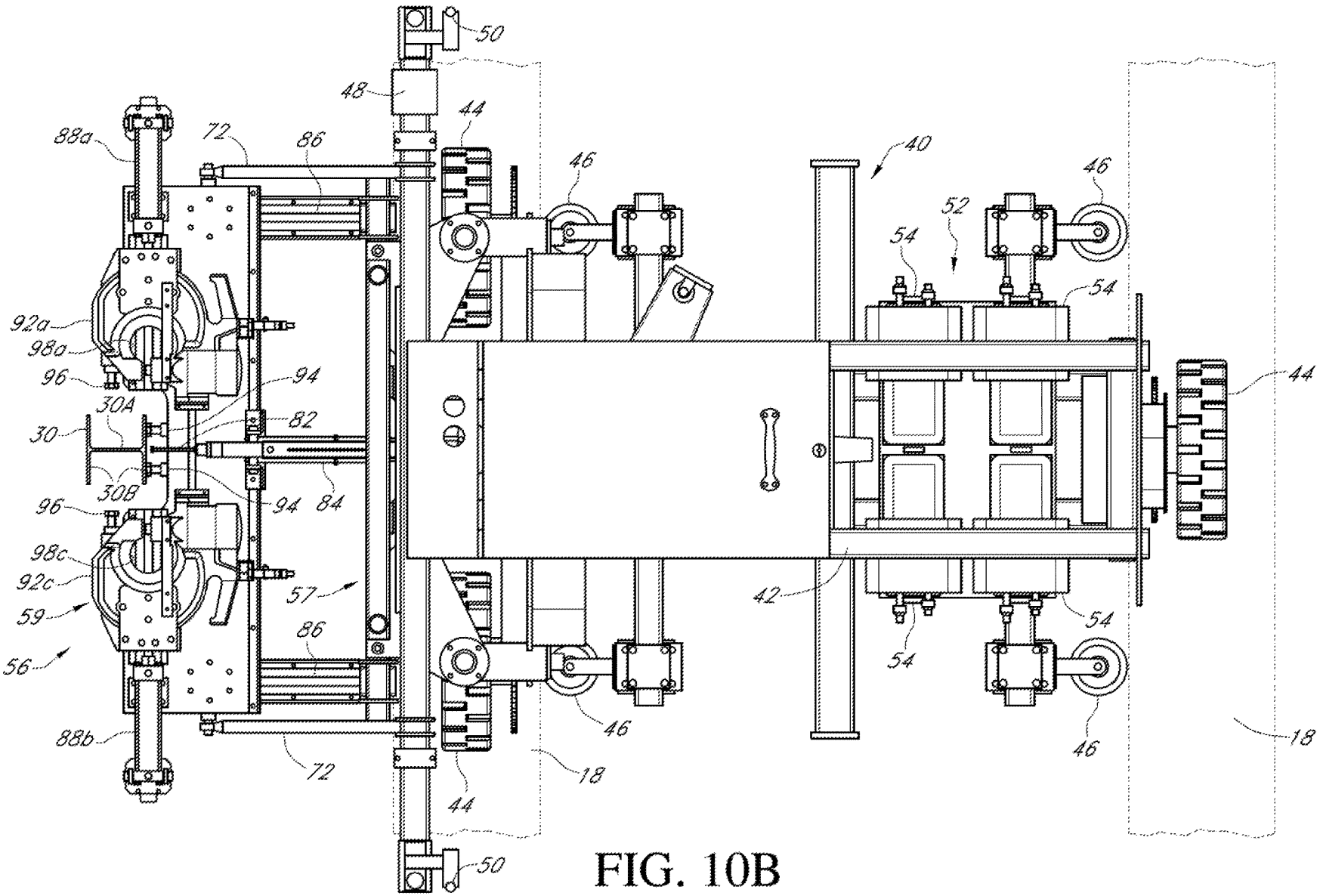
FIG. 10B depicts the hole forming assembly of the present invention set into position next to the post, with the wires and hoses removed to aid in viewing the components of the present invention.

Referring to FIGS. 10A-D, the punching operation of post punch machine 40 is explained. At this point in the process, the post punch machine 40 is on the plinths 18. The alignment wheels 46 of the machine 40 abut the plinths 18 and maintain plinth/machine alignment so that when the machine 40 is moved, the machine 40 stays in alignment with the plinths 18. With the siderail/plinth offset set and the machine 40 aligned with the plinths 18, the first holes 32 can be punched. To do so, the joystick 50 is used to move the machine 40 along the plinths 18 to the first post 30 to be punched (FIG. 10A). Once at the first post 30, in this embodiment, the operator uses the alignment device 82, which in this embodiment is a bolt, to align the machine 40 with the web 30A of the post 30. Once the machine 40 is aligned with the post 30, the operator uses the controls of the machine 40 to actuate the hydraulic arm 84, which pushes the punch claws 92*a-d* and the hydraulic arms 88*a-b* outward along the two sliding rails 86 until the stop-bolts 94 contact the front flange 30B (FIG. 10B). The stop-bolts 94 keep the flange 30B in position relative to the die 98*a-d* of each punch claw 92*a-d*. After the bolts 94 are in contact with the face of flange 30B, the di 98*a-d* of each punch claw 92*a-d* is aligned with the side of flange 30B so that the punch claws 92*a-d* can be moved to wrap around the flange 30B. Once aligned, the operator can begin punching the holes 32 in the flange 30B of the post 30. The operator can select which punch claws 92*a-d* to engage first. In this embodiment, punch claws 92*a-b* work from the same hydraulic arm 88*a*, and as such, they move and punch at the same time. In this embodiment, this is also the case for punch claws 92*c-d*. They too work together and operate from the hydraulic arm 88*b*, which is opposite hydraulic arm 88*a*. The invention is not limited to punch claws working together. In other embodiments, the punch claws 92 could operate in other configurations, such as independent of each other.

Figure 10C:
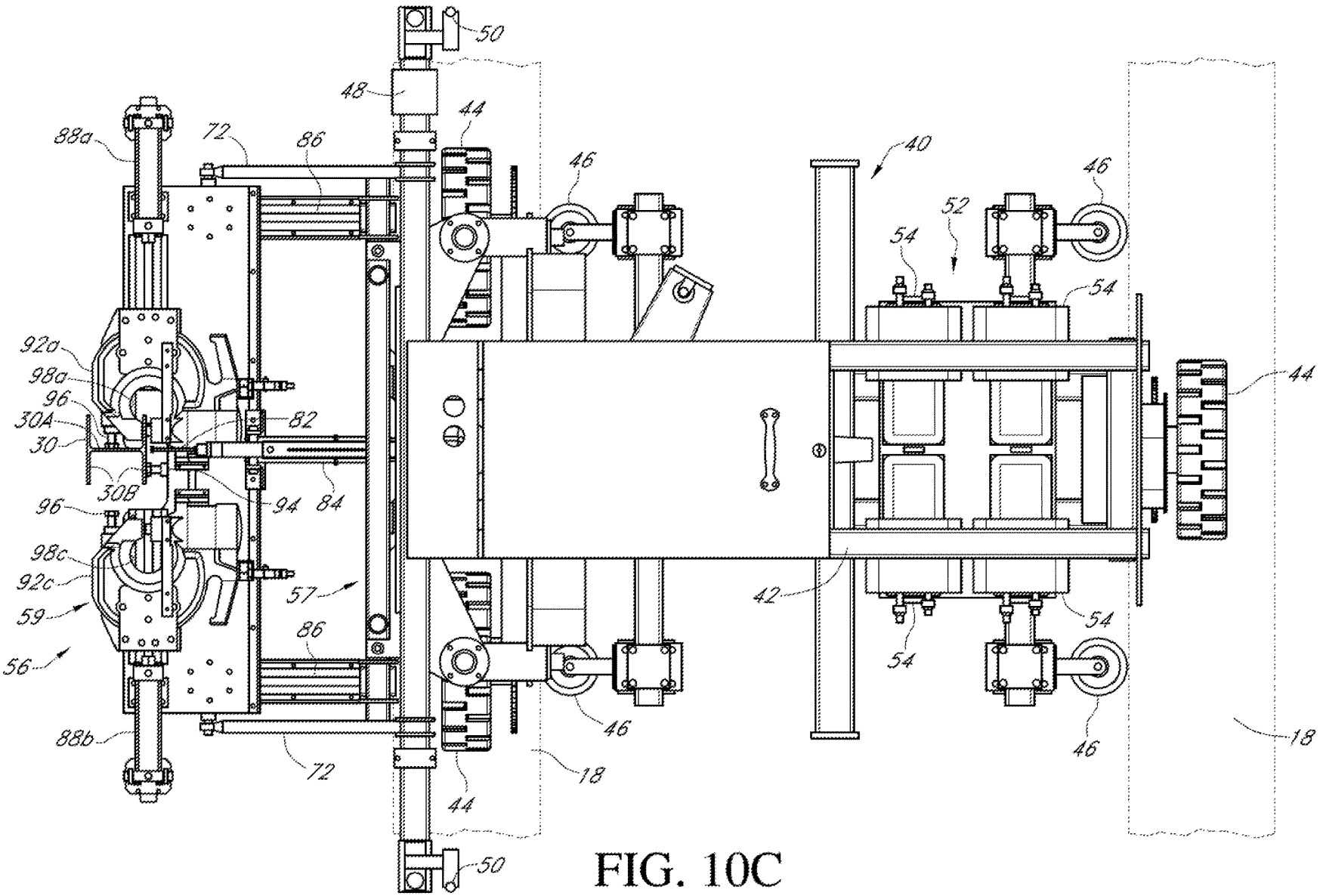
FIG. 10C depicts the claw punch assembly making a first punch, with the wires and hoses removed to aid in viewing the components of the present invention.
Figure 10D:
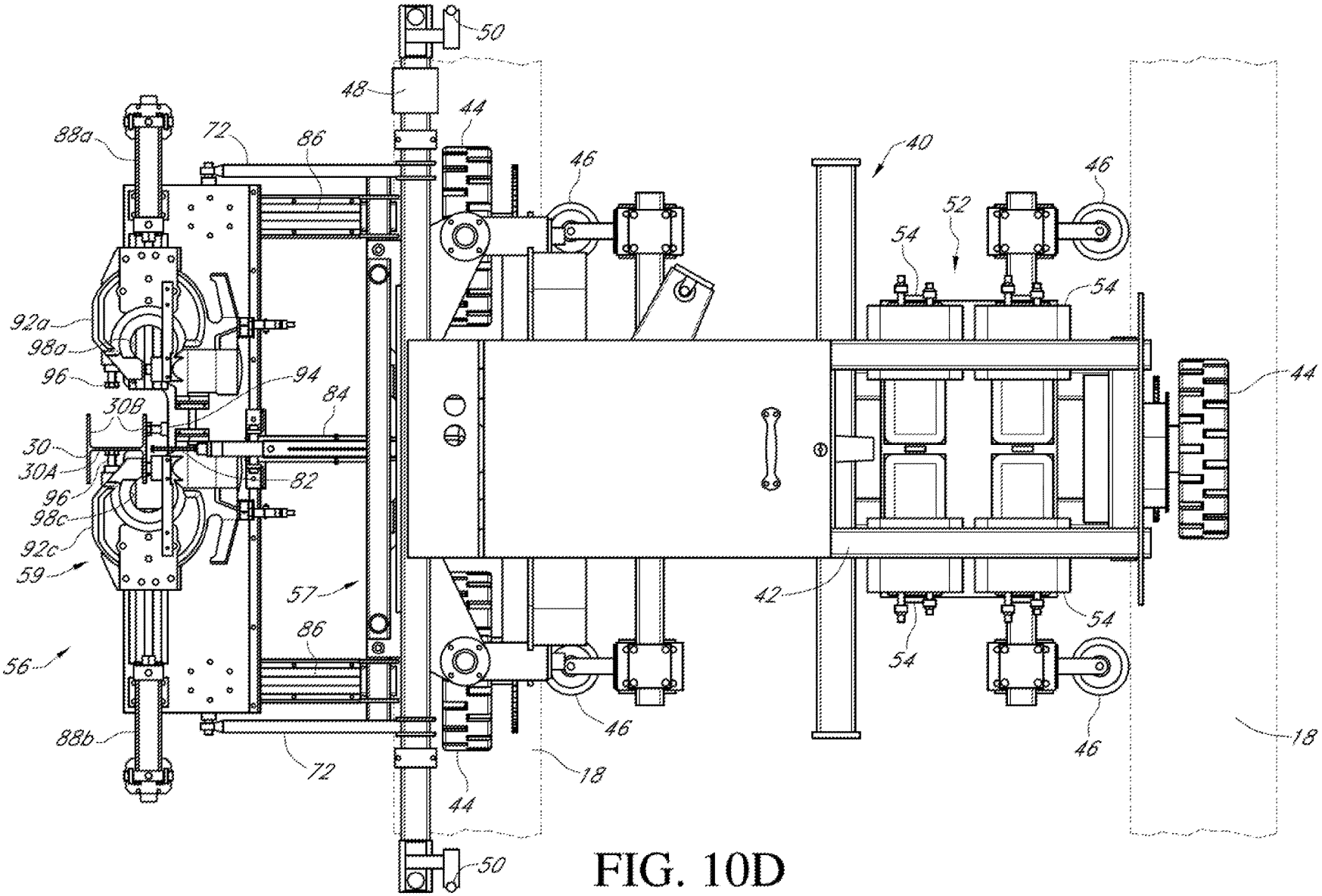
FIG. 10D depicts the claw punch assembly making a second punch, with the wires and hoses removed to aid in viewing the components of the present invention.
Figure 11:
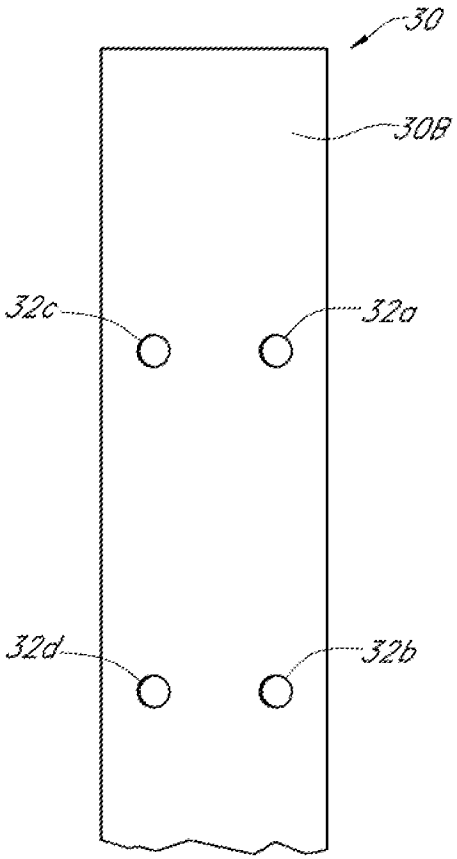
FIG. 11 depicts a post after a mobile punch machine of the present invention has punched holes in it.

Once the operator chooses which punch claws 92*a-d* to engage, the operator uses the joystick 50 to move the die 98*a-d* around the flange 30B. Referring to FIG. 10C, in this example, the operator chose to engage punch claws 92*a-b* first. The operator uses the joystick 50 to actuate hydraulic arm 88*a* to extend the dies 98*a-b* of punch claws 92*a-b* until the stop-bolts 96 come into contact with the web 30A of the post 30, which puts the punch claws 92*a-b* into position around the side of flange 30B. The operator then uses the control assembly 48 to actuate the hydraulic pumps 54 to close the punch claws 92*a-b* to exert enough pressure to punch holes 32*a-b* (FIG. 11) into the flange 30B of the post 30. Once the holes 32*a-b* are punched, the operator uses the control assembly 48 to disengage the punch claws 92*a-b* and retracts them back to a rest position. Referring to FIG. 10D, once the holes 32*a-b* are punched, the operator uses the punch machine 40 to punch holes 32*c-d* on the opposite side of flange 30B (FIG. 11). This is done in the same manner as used to punch holes 32*a-b*. The operator uses the joystick 50 to actuate hydraulic arm 88*b* to move the dies 98*c-d* of punch claws 92*c-d* until the stop-bolts 96 come into contact with the web 30A of the post 30, which puts the punch claws 92*c-d* into position around the side of flange 30B. As on the other side, the operator then uses the control assembly 48 to actuate the hydraulic pumps 54 to close the punch claws 92*c-d* to exert enough pressure to punch holes 32*c-d* into the flange 30B. Once the holes 32*c-d* are punched, the operator uses the control assembly 48 to disengage the punch claws 92*c-d* and retracts them back to a rest position. As seen in FIG. 11, the result is that the flange 30B is punched with the required holes 32*a-d*, with each one at the correct location. The hydraulic arm 84 is then actuated to retract the punch claws 92*a-d*, which move back along the slide rails 86, to a rest position. The process is complete for this post 30. In one embodiment, the punched holes 32*a-d* are spaced 4-inches on center from one another, and 2-inches from the web 30A of the post 30.

Once the holes 32*a-d* are punched in one post 30, the machine 40 is moved along the plinths 18 to the next post 30. Once at the next post 30, holes 32*a-d* are punched in this post 30 in the same manner as described above regarding the prior post 30. The process is repeated for each post 30 along the length of the plinths 18 for the entire project until all the required holes 32*a-d* are punched.

Although certain embodiments and features of a post punch machine have been described herein, the scope of coverage of this patent is not limited thereto. On the contrary, this patent covers all embodiments of the teachings of the disclosure that fairly fall within the scope of permissible equivalents.

What is claimed is:

1. An apparatus for punching holes in a plurality of posts, wherein an offset between the holes formed in the posts and a vehicle running surface must be maintained from post to post, the apparatus comprising:

a frame that contacts the vehicle running surface;

a generator; and a hole forming assembly, adjustably mounted to the frame, having punch claws, wherein the hole forming assembly is adjusted relative to the frame to maintain a constant offset between the punch claws and the vehicle running surface and wherein the generator powers the punch claws to punch holes, having a constant offset, in the plurality of posts, wherein the hole forming assembly has at least two threaded bolts and a plurality of nuts on each bolt and wherein the frame has a flange with at least two holes formed therein and one of the threaded bolts is disposed in each of the holes in the flange with the plurality of nuts disposed on opposite sides of the flange, such that the hole forming assembly can be adjusted relative to the frame by adjusting the threaded bolts relative to the flange and using the nuts to secure the position of the threaded bolts relative to the flange.

2. The apparatus of claim 1, wherein the hole forming assembly further comprises at least two stabilization rods and wherein the flange of the frame has at least two additional holes formed therein and one of the stabilization rods is disposed in each of the additional holes in the flange.

3. The apparatus of claim 1, wherein the hole forming assembly further comprises at least two adjustable rods that are attached to the frame, wherein the hole forming assembly can be adjusted relative to the frame by adjusting the adjustable rods relative to the frame.

4. The apparatus of claim 1, further comprising a hydraulic assembly powered by the generator, wherein the hydraulic assembly includes a plurality of hydraulic pumps that power the punch claws to punch holes in the plurality of posts.

5. The apparatus of claim 1, further comprising a compressor in communication with the frame for engaging the hole forming assembly relative to the frame.

6. The apparatus of claim 1, further comprising a plurality of support wheels connected to the frame and a plurality of alignment wheels connected to the frame, wherein the plurality of support wheels contact the plurality of plinths and are configured to move along the vehicle running surface, and wherein the plurality of alignment wheels are configured to abut a plurality of plinths defined by the vehicle running surface.

7. The apparatus of claim 5, wherein the hole forming assembly further includes an outwardly extending hydraulic arm coupled to the frame and supporting the punch claws, the outwardly extending hydraulic arm being operatively connected to the compressor.

8. The apparatus of claim 1, further comprising at least one control assembly connected to the frame and operable to control operation of the hole forming assembly.

9. The apparatus of claim 8, wherein the control assembly includes at least one joystick.

10. An apparatus for punching holes in a plurality of posts for an automated people moving system, wherein an offset between the holes formed in the posts and a plurality of plinths that an automated people mover of the system moves on must be maintained from post to post, the apparatus comprising:

a frame, having one or more support wheels, one or more alignment wheels, and a hydraulic assembly, wherein the one or more support wheels and the one or more alignment wheels contact the plinths;

a compressor in communication with the frame;

a generator in communication with the frame; and a hole forming assembly, having a lift assembly and a claw punch assembly having punch claws, wherein the hole forming assembly is adjustably mounted to the frame and wherein the hole forming assembly is adjusted relative to the frame to maintain a constant offset between the punch claws and the plinths and the hydraulic assembly powers the punch claws to punch holes in the plurality of posts.

11. The apparatus of claim 10, wherein the frame, compressor and generator are separate components.

12. The apparatus of claim 10, wherein the frame, compressor and generator are integral to one another.

13. The apparatus of claim 10, wherein the lift assembly further comprises a post alignment device.

14. The apparatus of claim 10, wherein the lift assembly further comprises at least two threaded bolts and a plurality of nuts on each bolt and wherein the frame has a flange with at least two holes formed therein and one of the threaded bolts is disposed in each of the holes in the flange with the plurality of nuts disposed on opposite sides of the flange, such that the hole forming assembly can be adjusted relative to the frame by adjusting the threaded bolts relative to the flange and using the nuts to secure the position of the threaded bolts relative to the flange.

* * * * *